United States Patent [19]

Watanabe et al.

[11] 3,983,801

[45] Oct. 5, 1976

[54] HIGH SPEED PRINTER

[75] Inventors: Akinori Watanabe; Katsuhide Tanoshima; Matsusaburo Noguchi, all of Tokyo, Japan

[73] Assignee: Oki Electric Industry Co., Inc., Tokyo, Japan

[22] Filed: Mar. 14, 1975

[21] Appl. No.: 558,248

[30] Foreign Application Priority Data

Apr. 18, 1974 Japan ..... 49-42766

[52] U.S. Cl. ..... 101/1; 101/DIG. 13; 346/74 ES

[51] Int. Cl.[2] ..... G03G 15/04

[58] Field of Search ..... 197/1 R; 101/1, 114, 101/DIG. 13; 346/75, 140, 74 ES; 355/3 R

[56] References Cited

UNITED STATES PATENTS

| | | | |
|---|---|---|---|
| 3,152,858 | 10/1964 | Wadey | 346/75 |
| 3,179,042 | 4/1965 | Naiman | 346/75 X |
| 3,211,088 | 10/1965 | Naiman | 101/1 X |
| 3,545,374 | 12/1970 | Hendricks | 346/75 X |
| 3,582,954 | 6/1971 | Skala | 101/1 X |
| 3,750,564 | 8/1973 | Bettin | 101/1 |
| 3,779,166 | 12/1973 | Pressman et al. | 101/1 X |
| 3,834,301 | 9/1974 | Croquelois et al. | 101/1 |

FOREIGN PATENTS OR APPLICATIONS

| | | | |
|---|---|---|---|
| 719,239 | 12/1954 | United Kingdom | 101/DIG. 13 |

OTHER PUBLICATIONS

McCurry et al., "Mist Ink Printers, " IBM Tech. Discl. Bull., vol. 15, No. 8, p. 2389, Jan. 1973.

*Primary Examiner*—Ralph T. Rader
*Attorney, Agent, or Firm*—Peter L. Berger

[57] ABSTRACT

A high speed printer for printing desired letters, figures, signs, etc., on a paper by depositing ink particles on the paper after properly controlling ink droplets or selectively controlling corpuscles, characterized in that at least one ink mist passage is provided at a location closely adjacent to the surface of ink solution. An air feed port also is provided for introducing air into said ink mist passage after the air passes the ink mist source or its vicinity so that the produced ink mist will flow into said ink mist passage without forming any small convection.

6 Claims, 10 Drawing Figures

HIGH SPEED PRINTER

BACKGROUND OF THE INVENTION

Elevated operating speed of central processor units of electronic computers has demanded corresponding speed-up of high speed printing machines which output unit of such computer and various systems have been developed to meet such demand.

A typical example of such known systems is the one in which ink is supplied to the nozzle under extremely low pressure so that ink is bulged out half-spherically from the nozzle end, then ink is drawn out in the form of droplets by providing an electric field between said nozzle and an accelerating electrode placed several millimeters ahead of the nozzle. The ink droplets are directed toward the surface of the printing paper by providing a strong electric field between the nozzle and the platen and further electrostatically deflected in both primary and secondary directions (right and left directions) to thereby print letters, signs, etc., on the surface of the paper.

There is also known a popularly employed system in which ions produced between the electrodes applied with a high voltage are passed through an ink mist so that they are deposited with ink particles, and then these ink particle-carrying ions are selectively adsorbed on the surface of the printing paper to thereby effect printing.

The device of the present invention pertains to the last-mentioned system, and so this system is first described in detail for facilitating better understanding of the present invention.

Referring to FIG. 1, reference numeral 101 denotes a paper on which printing is to be made (hereinafter referred to as printing paper), 102 a platen incorporated with a cathode 103, 104 a wire-shaped anode, and 105 an aperture board disposed in front of said anode 104 and consisting of a selecting electrode 105*mist* a common electrode 105*b* and an insulator 105*c* adapted to insulate said both electrodes from each other. This aperture board is provided in its surface with a plurality of apertures 105*d* arranged along the length of the board as shown in FIG. 2. Numeral 106 is an ink mist tank in which ink solution 107 is agitated by a plurality of vibrators 108 provided at the tank bottom so as to produce a mist of ink, 109 a main pump for feeding air both into the printing section and into said mist tank 106, and 110 a separator whereby the ink mist 112 recovered from the printing section 111 is separated into ink and air.

According to this system, ions are produced from the anode 104 and moved in the direction of the printing paper 101 by the action of an electric field formed between said anode 104 and cathode 103. In moving toward the printing paper, said ions pass through the apertures 105*d* in the aperture board 105, but their passage is either promoted or retarded as they receive the action of the electric field formed between the selecting electrode 105*a* and the common electrode 105*b*. Ion movement is promoted when the ions pass through the apertures 105*d* which correspond to the dots to be printed, and when these ions reach the ink mist 112 in the printing section 111, they are loaded with ink particles and further migrate toward the cathode 103 while carrying such ink particles therewith and then are adsorbed on the surface of the printing paper 101 to effect printing by way of dots. In this way, letters, figures, etc., in the form of dots are printed on the printing paper, with the above-described operation being programmed as main scanning and feed of the printing paper as auxiliary scanning.

In such type of high speed printing apparatus, it is often experienced that the letters, etc., are printed too lightly. This is mostly due to shortage or deficiency of ink mist supplied to the printing section 111 from the mist tank 106. That is, as there exists a certain distance between the mist source and the mist delivery port, the ink particles tend to be diffused by the air supplied for carrying the ink mist in the mist tank 106 to the printing section 111, and also many small convections are formed in the mist tank, and these factors to reduce the amount of ink mist which is actually carried into the printing section by said air.

SUMMARY OF THE INVENTION

The present invention features the facts that at least one ink mist passage is provided at a location closely adjacent to the surface of ink solution, and that an air feed port is positioned such that the air is driven into said ink mist passage after passing the ink mist source or the vicinity thereof.

OBJECTS OF THE INVENTION

The first object of the present invention is to provide a mechanism for supplying a large amount of ink mist produced in a mist tank to the printing section.

The second object of the present invention is to provide a mechanism whereby the ink particles are hardly diffused and also no small convection is formed in the mist tank.

DETAILED DESCRIPTION OF THE INVENTION

Figure 1:
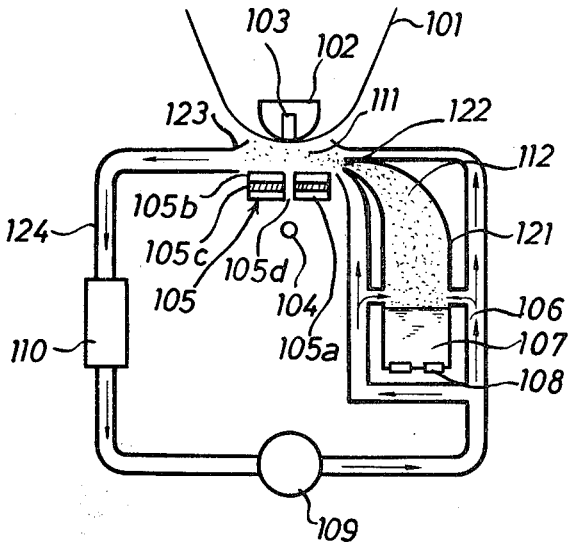
FIG. 1 is an illustrative arrangement plan of a high speed printer.
Figure 2:
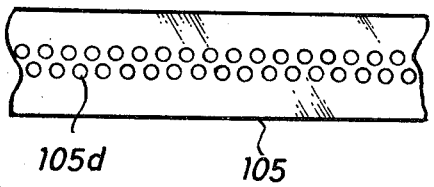
FIG. 2 is a partial plan view of an aperture board.

As described above, an aperture board 105 is provided between an anode 104 formed from a wire-shaped electrode and cathode 103 incorporated in a platen 102. Said aperture board 105 has a selecting electrode 105*a* on the anode side and common electrode 105*b* on the cathode side, with an insulating member 105*c* being interposed therebetween. Said board is also provided with a plurality of apertures 105*d* arranged in two lines in staggered relation along the length of the board, and an ion controlling electrode is formed for each of said apertures. The selecting electrode 105*a* is connected to a drive circuit not shown so that it is selectively driven to a positive or negative potential depending on the potential of the common electrode 105*b* which is always retained at a given potential.

Now the mechanism for supplying ink mist 112 to the printing section 111 between said aperture board 105 and platen 102 is described. Formed at the top of the mist tank 106 are the passages 113 arranged in correspondence to the respective vibrators 108 provided at the bottom of the mist tank 106 containing an ink solution 107 therein, with an end of each of said passages 113 being positioned close to the surface of said ink solution 107. At the upper side portion of said mist tank 106 is also provided an air inlet 114 for introducing air into the mist tank 106. The air thus introduced into the mist tank tends to blow out upwardly through said respective passages 113. During this action, such air guides the ink mist 112 produced by the vibrators 108 into said passages 113 and carries the ink mist therewith upwardly.

Figure 3:
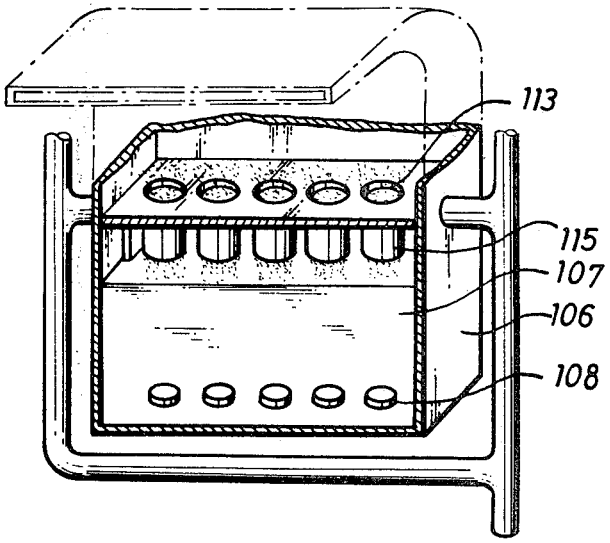
FIG. 3 is a sectional perspective view of a mist tank.
Figure 4:
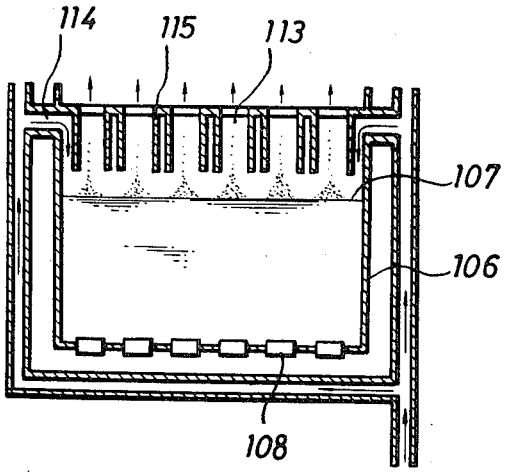
FIG. 4 is a vertical sectional view of the mist tank.
Figure 5:
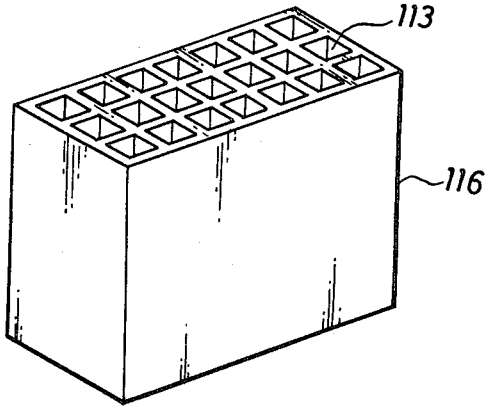
FIG. 5 is a perspective view showing the ink mist passages.
Figure 6:
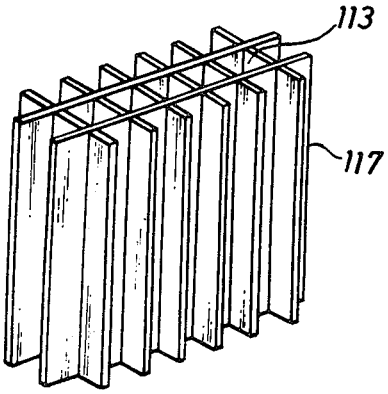
FIG. 6 is a perspective view showing another example of ink mist passages.

Said passages 113 may be either formed individually from pipes 115 as shown in FIGS. 3 and 4 or may be formed collectively in a block 116 or from partition plates 117 as shown in FIGS. 5 and 6. Also, such passages 113 may not necessarily be provided at the positions corresponding to the respective vibrators 108.

Figure 7:
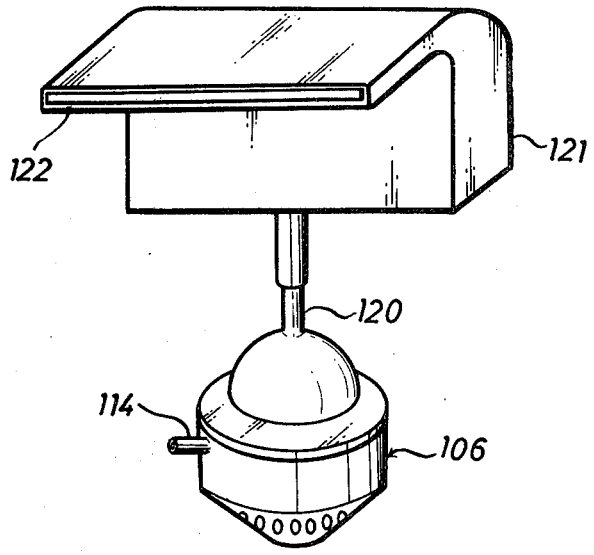
FIG. 7 is a perspective view of a mist tank and a reservoir tank in another embodiment of the present invention.
Figure 8:
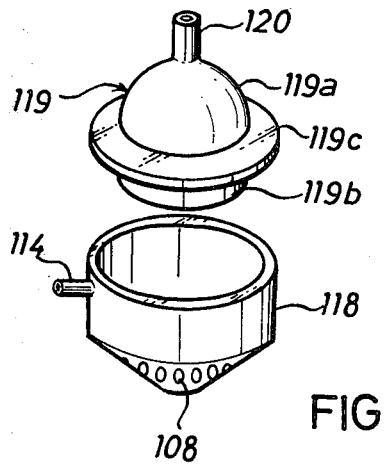
FIG. 8 is an exploded perspective view of said mist tank.
Figure 9:
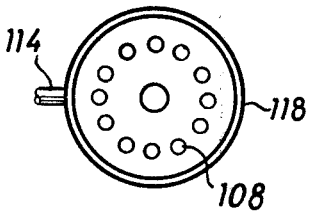
FIG. 9 is a plan view of a mist generator in said mist tank.

FIG. 7 shows a mist tank according to another embodiment of the present invention. In this case, the mist tank 106, which is circular in sectional shape, is composed of two separatable upper and lower portions, with the lower portion constituting a mist generator 118 designed to produce ink mist from ink solution stored therein while the upper portion constitutes a mist distributor 119 designed to cover said mist generator 118 and to supply the produced ink mist to the printing section 111. Said mist generator 118, as best shown in FIG. 9 is provided at its bottom with a plurality of circularly arranged vibrators 108 and is also formed in its peripheral side with an air inlet port 114 through which air is introduced for carrying therewith the ink mist 112 to the printing section 111. Said mist distributor 119 is shaped like a dome and provided at its top with a passage 120 for delivering the ink mist 112 to the printing section 111. This mist distributor comprises a mist distributing portion 119*a*, an ink mist collecting portion 119*b* and a flange 119*c* disposed between said distributing portion 119*a* and collecting portion 119*b*. Said flange 119*c* of the mist distributor 119 is placed on the top end of the mist generator 118 to constitute the mist tank 106 as shown in FIGS. 7 and 10.

Figure 10:
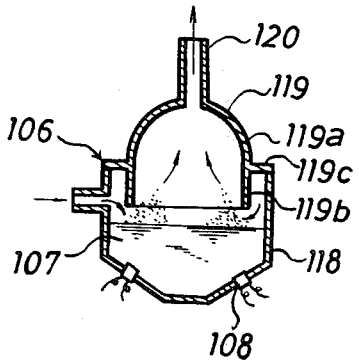
FIG. 10 is a longitudinal sectional view of said mist tank.

FIG. 10 shows the mist tank 106 in vertical section. It willl be seen that the mist collecting portion 119*b* of the mist distributor 119 runs out into the inside of the mist generator 118, and an air passing space is formed between the opposing faces of said collecting portion 119*b* and mist generator 118. The air entering said space is carried into the mist generator 118 through the air inlet port 114 and flows in the direction of arrows in the figure. The inlet opening of the collecting portion 119*b* of the mist distributor is placed in opposition to the surface of the ink solution 108 stored in the mist generator 118. Therefore, the ink mist generated from the ink solution by agitating of the vibrators 108 in the same way as described before is driven upwardly by the air and forcibly transferred into the mist passage 120. Thus, the ink mist is effectively and entirely carried into the printing section 111 without creating any small convection. In this way, the ink mist carried up while riding on the air stream as described above enters the reservoir tank 121 and then is discharged out to the printing section 111 from an opening 122 directed toward the space between the aperture board 105 and the platen 102 (hence the printing paper 101). On both upper and lower sides of the ink mist in the printing section 111 are formed air streams flowing in the same direction as the ink mist flow so as to prevent the printing paper 101 and aperture board 105 from being stained by the ink mist. It is to be also noted that an ink mist and air collecting port 123 is provided in opposition to said opening 122, said collecting port 123 being connected to a separator 110 by way of a conduit 124 and thence further to the pump 109 through a cooler or other means.

Now the operation of the present device having the above-described arrangement is described. In order to obtain desired printing patterns, each selecting electrode 105*a* is energized to effect control of migration of the cations for all of the apertures 105*d*, and the cations which have passed said apertures 105*d* enter the ink mist 112 and are deposited with fine ink particles. These ink particle-carrying cations continue their migration in the direction of the cathode 103 until they are adsorbed on the surface of the printing paper 101 to thereby effect printing by way of dots. Such printing is accomplished all at once in the direction of width of the printing paper 101. In this way, the letters consisting of plural dot patterns are printed all together in lines with the above-said operation being programmed as main scanning and feed of the printing paper 101 as auxiliary scanning.

As described above, the ink mist 112 produced by the vibrators 108 in the mist tank 106 and supplied in between the printing paper 101 and aperture board 105 passes through the passages 113 (and 120) along with air, then guided into the reservoir tank 121 and discharged out from the opening 122 with uniform density. A part of the thus discharged ink mist is used for effecting printing in the form of dots as described above, while the remainder is collected in the collecting port 123 together with air stream, and the mixture of such ink mist and air is guided into the separator 110 where the ink particles and air are separated from each other, with the thus separated air being transferred into a cooler to be cooled therein and then further carried into the main pump 109 for reuse as fresh air in the mist tank 106 and in the printing section 111.

As viewed above, according to the high speed printing apparatus of the present invention, as passages are provided in the top of the mist tank, the air introduced into the mist tank can be regulated so that it rises up through said passages after passing the ink mist source of the neighborhood thereof, so that such air can prevent the ink mist produced by the vibrators from forming small convections, and hence the ink particles are bonded to each other and carried into the printing section along with the air before they are again liquefied. Also, since one end of each of said passages is positioned close to the surface of the ink solution, it is possible to increase the air flow rate at or in the vicinity of the ink mist source, so that the produced ink mist can be immediately dragged into the air stream and guided into said passages. Consequently, it becomes possible to increase the ink mist supply as compared with the conventional systems and to consistently maintain the clear and uniform printing operation.

What is claimed is:

1. A high speed printer for printing symbols comprising a printing paper on which said symbols are printed, ink being deposited on said paper by charging ink drops and selectively electrically controlling said ink drops, said ink drops being formed from an ink mist, said ink mist being supplied to the vicinity of said printing paper under control of an air flow stream through an ink mist passage, an ink reservoir containing said ink and a plurality of vibrators for vibrating said ink to form an ink mist above the top of the surface of the ink and a source of air flow for carrying said ink mist to the vicinity of said printing paper through said ink mist passage, characterized in that said ink mist passage is formed of a surface having one end thereof in close proximate relation to said surface of the ink and an air feed port is provided to carry said air to the vicinity of said surface of the ink to carry the ink mist directly into said ink mist passage.

2. A high speed printer as set forth in claim 1, wherein said ink mist passage comprises a plurality of parallel separated chambers, with one end each of said chambers being in close proximate relation to said ink surface.

3. A high speed printer as set forth in claim 2, comprising a plurality of vibrators, with respective ones of said vibrators being located below respective ones of said chambers.

4. A high speed printer as set forth in claim 1, wherein said ink mist passage comprises a plurality of vertically oriented channels, said channels being formed of a plurality of vertically extending parallel baffle members defining said separate channels said ink mist being carried through said plurality of channels.

5. A high speed printer as set forth in claim 1, wherein said ink mist passage comprises a vertically oriented block containing a plurality of separate chambers arrayed vertically in matrix form with the bottom of the block being in close proximate relation to said ink surface.

6. A high speed printer as set forth in claim 1, wherein said ink reservoir comprises a dome-shaped mist distributor provided with a passage at its top and a flange around a pertinent peripheral part thereof, and a mist generator provided with a plurality of said vibrators at its bottom and an air inlet pipe at an upper peripheral part thereof, both said mist distributor and said mist generator being combined together by placing the flange of said mist distributor on the top end of said mist generator, with the bottom end of said mist distributor being positioned close to the surface of the ink.

* * * * *